US005299369A

United States Patent [19]

Goldman

[11] Patent Number: 5,299,369

[45] Date of Patent: Apr. 5, 1994

[54] SHOE WITH RETRACTABLE SPIKE ASSEMBLY

[76] Inventor: Neil M. Goldman, 13 Sunset Dr., Randolph, Mass. 02368

[21] Appl. No.: 7,162

[22] Filed: Jan. 21, 1993

[51] Int. Cl.[5] ..... A43C 15/00

[52] U.S. Cl. ..... 36/61; 36/127; 36/29

[58] Field of Search ..... 36/127, 128, 59 R, 59 B, 36/59 C, 29, 134, 61, 62

[56] References Cited

U.S. PATENT DOCUMENTS

| | | | |
|---|---|---|---|
| 3,716.931 | 2/1973 | Loudermilk | 36/61 |
| 3,793,751 | 2/1974 | Gordos | 36/134 X |
| 4,375,729 | 3/1983 | Buchanen, III | 36/134 X |
| 4,821,434 | 4/1989 | Chein | 36/134 |
| 4,825,562 | 5/1989 | Chuang | 36/134 X |
| 4,873,774 | 10/1989 | Lafever | 36/29 X |

FOREIGN PATENT DOCUMENTS

| | | | |
|---|---|---|---|
| 1957191 | 6/1970 | Fed. Rep. of Germany | 36/61 |
| 7404947 | 10/1975 | France | 36/61 |

*Primary Examiner*—Paul T. Sewell
*Assistant Examiner*—BethAnne C. Ciconi
*Attorney, Agent, or Firm*—Herbert L. Bello

[57] ABSTRACT

A sport shoe having a plurality of pneumatically actuated, rotatable spikes that are mounted in open ended chambers formed in the shoe sole, each spike having a narrow tip. Each spike is constrained for movement between extended and retracted position. A stop is provided in each chamber for holding the spikes in their extended positions, the spike tips project outwardly from the chambers when in their extended positions. A pneumatically actuated bladder in each chamber when inflated, drives the spikes to their extended positions against the stops. Each spike is rotated beyond a vertical axis or centerline that is perpendicular to the axis of rotation of that spike. A spring operatively connected to each spike rotates the spikes to their retracted positions within the chambers when the bladders are deflated.

13 Claims, 2 Drawing Sheets

SHOE WITH RETRACTABLE SPIKE ASSEMBLY

BACKGROUND OF THE INVENTION

1. Field of the Invention

This present invention relates to sport shoes, and, more particularly, is directed toward sport shoes with retractable spikes.

2. Description of the Prior Art

Sports shoes, such as golf shoes, have a plurality of spikes which project outwardly from the bottom of the shoe. The spikes are designed to dig into the ground and provide a solid footing. They prevent the golfer's foot from slipping laterally while swinging a golf club. A disadvantage of standard golf shoes is that the golfer must change shoes before entering restaurants, the club house and other facilities because the spikes would damage wooden floors and rip carpets. Also, it is not safe to operate an automobile while wearing spiked shoes.

Golf shoes containing various forms of retractable cleat designs are know in the prior art. U.S. Pat. No. 3,716,931 discloses a golf shoe with a spike or cleat that is pivotally mounted in a receptacle in the bottom of the shoe. The spike is moved to its extended position and is held in place by a cover. The spike projects through a hole in the cover. U.S Pat. No. 4,873,774, shows a golf shoe with a plurality of vertically movable spikes, each spike being received in a chamber formed in the shoe sole. Pneumatic pressure applied to an inflatable member in each chamber forces a slidable cleat plate, which carries the cleats, downwardly and moves the spikes to their extended positions. The spikes are held in the extended position by means of continued pneumatic pressure which exerts a downward force on the cleat plates. The continuous pneumatic pressure counters the upward force that is exerted on the cleat plate as the cleat is pushed into the ground.

Prior art golf shoes with retractable spikes have been met with limited success. In one instance, the process of moving each cleat to its extended position is time consuming and requires manual intervention to remove the perforated covers, extend the spikes and hold the spikes in place by replacing the covers. In another case, the spikes are maintained in their extended positions by continuous pneumatic pressure. The high stress placed on the spikes, particularly the continuously applied high inflation pressure required while playing, causes excessive wear and tear on the inflatable members which hold the spikes in their extended positions. In consequence, the inflatable members may fail prematurely with the result that spikes return to their retracted position. In addition, the latter arrangement is designed only for short term usage and is not well suited for extended wear, for example, as required of golf shoes.

SUMMARY OF THE INVENTION

It is an object of the present invention to provide a sport shoe with retractable spikes which does not suffer from the disadvantages and limitations of prior art retractable spiked shoes.

It is another object of the invention to provide a sport shoe with retractable spikes which can be worn while not actually playing a sport and which can be easily converted to a spiked golf shoe.

It is a further object of the invention to provide a golf shoe with pneumatically actuated, retractable spikes which can withstand the stress of golf play conditions without putting high pressure on the spike actuating mechanism when the spikes are extended, thus causing premature failure of the actuating mechanism.

It is yet another object of the invention to provide a golf shoe with retractable spikes which can be worn constantly during a complete round of golf and withstand the pressure of the necessary, but incidental, pressure on the golf shoe from the player standing on pavement or rocks while walking or playing golf.

It is still a further object of the invention to provide a golf shoe with retractable spikes in which the actuation of the spike is easily controlled by a wearer using a pneumatic actuator.

The invention is characterized by sport shoe, for example a golf shoe, having a plurality of pneumatically activated, retractable spikes, each spike being rotatably mounted in a housing that is disposed in an open-ended chamber formed in the sole of golf shoe. Each spike has an enlarged head and a narrow tip. A trunnion or pin is provided in each housing for mounting a spike therein, the pin passing through the enlarged head of the spike. The spikes are rotatable about the pin and constrained for movement between extended and retracted positions. Each housing has a bearing surface that terminates in a stop which prevents further rotation of the spikes as they are moved to their extended positions. The spike tips project outwardly from the shoe sole when in their extended positions. A pneumatically actuated bladder is received in each housing. A hinged plate is disposed between the bladder and the open end of the housing. When the bladders are inflated, they press against the hinged plates which, in turn, rotate the spikes to their extended positions. Each spike is rotated beyond a vertical axis or centerline that is perpendicular to the axis of rotation of that spike, the spikes pressing against the stops. When a wearer steps on the shoe, an upward force is exerted on the extended spike and the spike bears against the stop. A spring which is operatively connected to each spike returns the spikes to their retracted positions within the chambers when the bladders are deflated.

Other objects of the present invention will in part be obvious and will in part appear hereinafter.

The invention accordingly comprises the apparatuses, processes and products, together with their parts, steps, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENT

Figure 1:
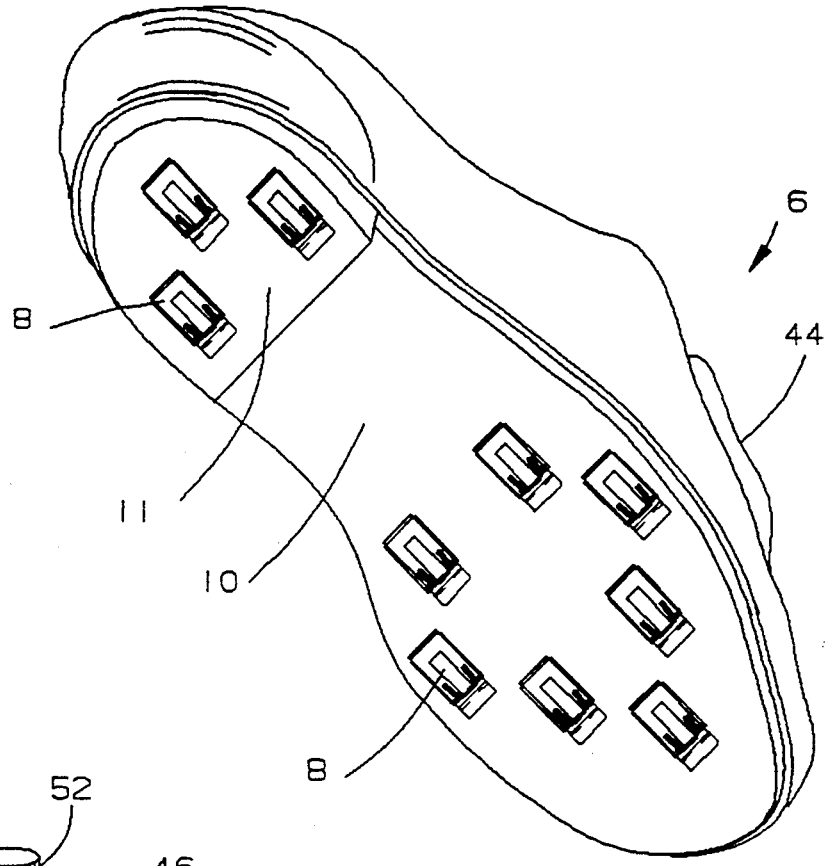
FIG. 1 is a perspective view of the sport shoe embodying the invention.
Figure 2:
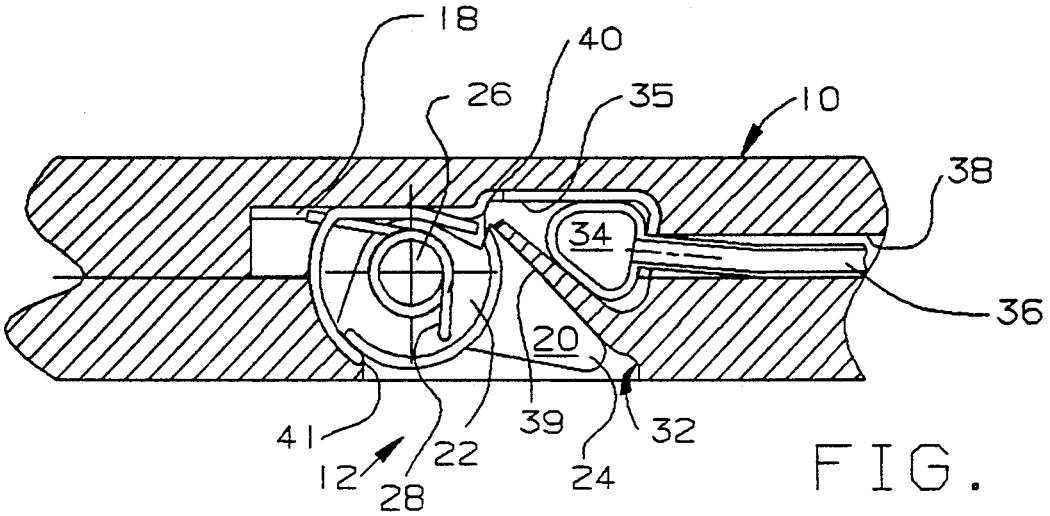
FIG. 2 is a side view, in section, of the sport shoe of FIG. 1 with a golf spike in its retracted position.
Figure 3:
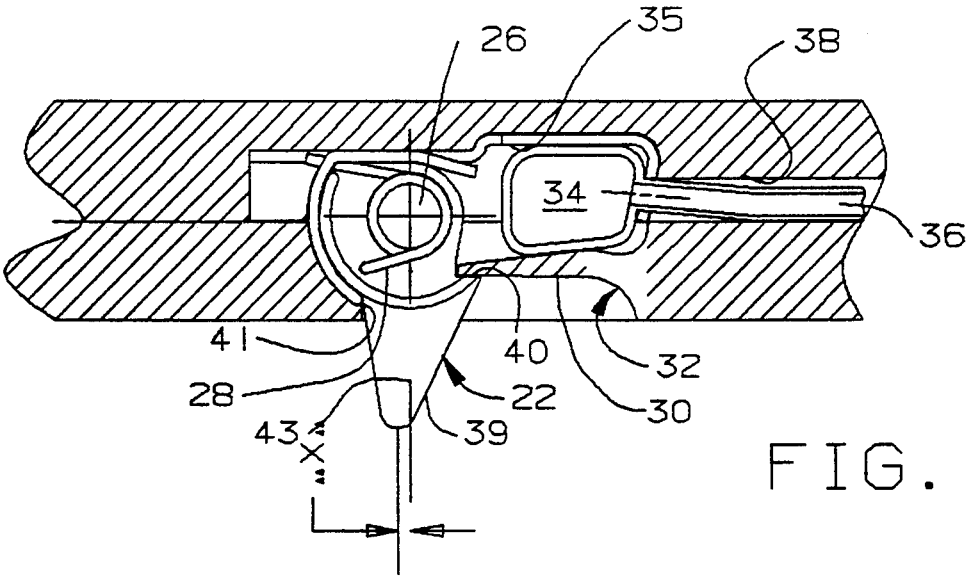
FIG. 3 is a side view, in section, of the sport shoe of FIG. 1 with a golf spike in its extended position; and, FIG. 4 is a perspective view of the pneumatic actuator for the golf shoe, including a valve for the retention and release of air.

With reference to the drawings, particularly FIG. 1, there is shown a sport shoe 6 , for example a golf shoe, having a plurality of generally rectangular chambers 8 formed in a sole 10 and heel 11 of the shoe. As best shown in FIGS. 2 and 3, a housing 12 having sidewalls 14, end walls 16 and a top wall 18 is secured in each chamber 8. A spike 20, which is rotatable from a retracted position to an extended position, has an enlarged head 22 that terminates in a narrow tip 24. Spike 20 is attached to the housing 12 by a trunnion 26, for example a pin, about which the spike rotates. A spring 28, for example, a torsion spring, is operatively connected to the spike 20. Spring 28 is located within the housing and provides the torque to move the spike to its retracted position and retain the spike in that position. Torsion spring 28 is sufficiently strong to hold spike 20 in its retracted position and is sufficiently weak to permit the spike to be rotated to its extended position.

As shown in FIG. 2, a leaf section 30 which is formed in the sole 10 at the bottom edge of chamber 8 pivots at a hinge area 32. As shown in FIG. 3, the leaf section 30 pivots in a downward direction as the spike 20 moves to its extended position. Leaf section 30 pivots in an upward direction when the spike 20 returns to its retracted position within the housing 12. The positioning of the leaf section 30 adjacent to the spike 20 prevents dirt and other foreign objects from entering the housing 12 when the spike 20 is in its extended position.

A pneumatically actuated bladder 34 is located in each housing 12 in an enclosed area 35 formed between the leaf section 30 and the housing. Bladders 34 are connected to an actuator 44 by means of tubing 36 which is disposed in channels 38 formed in the sole 10 of the shoe.

In FIG. 3, the bladder 34 is inflated and spike 20 is in its extended position. The bladder 34, which expands due to the introduction of air through the tubing 36, exerts pressure against the leaf section 30. The hinged leaf section 30 pivots downwardly against a camming surface 39 of spike 20. In consequence, spike 20 pivots around the trunnion 26 and is driven toward its extended position. The spike 20 is locked in its extended position when the leaf section 32 comes to rest in a notch 40, and the spike bears against a stop 41 in housing 12. In its extended position, the spike 20, has rotated a distance "x" beyond a vertical axis or centerline 43 that is perpendicular to the axis of rotation of the spike. The rotation of each spike 20 beyond the centerline 43 means that pressure is not applied against leaf section 30 and bladder 34.

Figure 4:
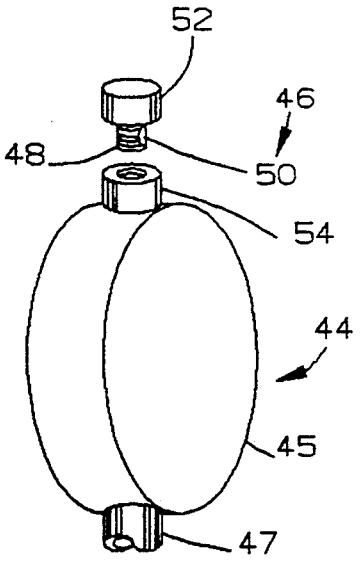

With reference to FIG. 4, there is shown an inflator 44 connected to all of the bladders 34 via the tubing 36. In the preferred embodiment, the inflator 44 is a pneumatic pump of the type used with blood pressure cuffs. Actuator 44 is attached or sewn to shoe 6, as shown in FIG. 1. Pumping of the inflator 44 causes air to be pumped into the bladders 34 via tubing 36. As the bladders 34 are inflated, the spikes 20 are rotated into their extended positions. In FIG. 1, the inflator 44 is shown as being mounted on the upper of shoe 6. It will be readily appreciated that in other embodiments, the inflator can be mounted at other locations, for example, adjacent to the tongue, on the tongue, at the back of the shoe, etc. In addition, inflator 44 can be mounted external of the shoe 6, for example at the user's waist. As shown in FIG. 4, the actuator 44 includes a resilient body or bulb 45, a valve 46 and an outlet 47. Valve 46 controls the inflation of bladders 34 for driving spikes 20 to their extended positions and the deflation of the bladders which results in removal of pressure so that the spikes can return to their retracted positions. In the illustrated embodiment, valve 46, for example, the type of valve used with blood pressure cuffs, includes a hollow threaded stem 48, having a hole 50 and a head 52. Stem 48 is threaded into an internally threaded socket 54. When stem 48 is fully threaded in socket 54, pumping of bulb 45 inflates bladders 34 and provides the pressure necessary to rotate all the spikes 20 to their extended positions. When stem 48 is turned outwardly so that hole 50 extends out of socket 54, pressure in bladders 34 is released, and the bladders deflate and torsion springs 28 drive the spikes 20 to their retracted positions.

Since certain changes may be made in the foregoing disclosure without departing from the scope of the invention herein involved, it is intended that all matter contained in the above description is depicted in the accompanying drawings be construed in an illustrative and not in a limiting sense.

What is claimed is:

1. A sport shoe having an upper and a sole, said sport shoe comprising:
   (a) a plurality of open-ended chambers formed in the sole of the shoe, each said chamber opened at a bottom of the sole;
   (b) a spike rotatably mounted in each said chamber, said spike rotatable between a retracted position and an extended position, each said spike retracted into its chamber when in said retracted position, each said spike projecting outwardly and downwardly from the sole when in said extended position; and
   (c) actuator means for moving said spikes between said retracted positions and said extended positions, each said spike rotating beyond a vertical centerline passing through the axis of rotation of that said spike when moved from said retracted position to said extended position by said actuator means.

2. The sport shoe as claimed in claim 1 including an open-ended housing mounted in each of said chambers, one of said spikes rotatably mounted in one of said housings.

3. The sport shoe as claimed in claim 1 including a leaf section hinged at said open end of each said chamber, said leaf section configured to engage said spike mounted in said chamber, one of said actuator means mounted in each of said chambers, said actuator means moving said leaf sections, said moving leaf section engaging one of said spikes and rotating said spike to said extended position.

4. The sport shoe sole as claimed in claim 2 including a leaf section hinged at said open end of each said chamber, said leaf section configured to engage said spike mounted in said chamber, and wherein said actuator means includes an inflator and a plurality of inflatable bladders, one of said bladders mounted in each said chamber in contact with said leaf section, inflated ones of said bladders expanding and exerting pressure against said leaf sections for rotating said spikes to said extended positions.

5. The sport shoe as claimed in claim 4 including a spring means mounted in each said chamber for engagement with said spike in that said chamber, said spring means moving said spike from its extended position to its retracted position when said bladder is deflated.

6. The sport shoe as claimed in claim 4 including a trunnion mounted in each said chamber, each said spike rotatably mounted in said housings by said trunnion.

7. A sport shoe having an upper and a sole, said sport shoe comprising:

(a) a plurality of open-ended housings mounted to the sole of the shoe in spaced relationship to one another, each said housing opened at the bottom of the sole;

(b) a leaf section hinged to each said housing at said open end;

(c) a plurality of spikes, one of each said spikes rotatably mounted in each said housing, each said spike rotatable between a retracted position and an extended position, said spike retracted into said housing when in said retracted position, each said spike projecting outwardly and downwardly from the sole when in said extended position; and (d) actuator means for moving said spikes between said retracted position and said extended positions, each said spike rotating beyond a vertical centerline passing through the axis of rotation of said spike when moved from said retracted position to said extended position by said actuator means.

8. The sport shoe as claimed in claim 7 wherein each said actuator includes an inflator and a plurality of inflatable bladders, one of said bladders means mounted in one of said housings, each said bladder, when inflated, engages and moves one of said leaf sections in said housing with said bladder, said leaf sections bearing against and moving said spikes to said extended positions when said bladders are inflated.

9. The sport shoe as claimed in claim 7 including a stop means in each said housing for limiting movement of said spikes, each said spike rotating beyond said vertical centerline and bearing against one of said stop means when in said extended position.

10. A sport shoe having an upper and a sole, said sport shoe comprising:

(a) a plurality of open-ended housings in the sole of the shoe, each said housing opened at the bottom of the sole;

(b) a spike rotatably mounted in each said housing, each said spike having a camming surface, each said spike rotatable between a retracted position and an extended position, each said spike retracted into said housing when in said retracted position, each said spike projecting outwardly and downwardly from the sole when in said extended position;

(c) a leaf section hinged at said open end of each said housing, said leaf section configured to bear against said camming surface of said spike and rotate said spike to said extended position; and (d) actuator means for moving said spikes between said retracted and extended positions, each said spike rotating beyond a vertical centerline passing through the axis of rotation of said spike when moved from said retracted position to said extended position by said actuator means.

11. The sport shoe as claimed in claim 10, including a stop means in each said housing for limiting movement of said spikes, each said spike rotating beyond said vertical centerline and bearing against one of said stop means when in said extended position.

12. The sport shoe as claimed in claim 11 wherein each said actuator means includes an inflator and a plurality of inflatable bladders, one of said bladders means mounted in one of said housings, each said bladder, when inflated, engages and moves one of said leaf sections, said leaf sections bearing against and moving said spikes to said extended positions when said bladders are inflated.

13. The sport shoe as claimed in claim 12 including a spring means mounted in each said housing for engagement with said spike mounted in that said housing, said spring means moving its respective one of said spikes from said extended to said retracted positions when said respective bladder is deflated.

* * * * *